US006205688B1

(12) United States Patent
Grosser-Samuels

(10) Patent No.: US 6,205,688 B1
(45) Date of Patent: Mar. 27, 2001

(54) JEWELRY DISPLAY DEVICE

(76) Inventor: Jacquelin Annette Grosser-Samuels, 18024 Rock Branch, Dallas, TX (US) 75287

( * ) Notice: Subject to any disclaimer, the term of this patent is extended or adjusted under 35 U.S.C. 154(b) by 0 days.

(21) Appl. No.: 09/302,129

(22) Filed: Apr. 29, 1999

(51) Int. Cl.[7] ..... G09F 1/00
(52) U.S. Cl. ..... 40/124.06; 206/6.1
(58) Field of Search ..... 40/124.06, 124.16, 40/124.4; 206/6.1

(56) References Cited

U.S. PATENT DOCUMENTS

| | | | |
|---|---|---|---|
| D. 243,733 | | 3/1977 | Shaw et al. . |
| D. 250,158 | | 11/1978 | Kelly . |
| D. 256,858 | | 9/1980 | Bedrosian . |
| D. 269,145 | | 5/1983 | Druiz et al. . |
| D. 269,766 | | 7/1983 | Strasser et al. . |
| D. 304,793 | | 11/1989 | Burke . |
| D. 316,346 | | 4/1991 | Jackson et al. . |
| D. 317,233 | | 6/1991 | Kelly . |
| D. 327,997 | | 7/1992 | Rubin . |
| D. 329,763 | | 9/1992 | Cuminale . |
| D. 351,075 | | 10/1994 | Rubin et al. . |
| D. 369,484 | | 5/1996 | Lee . |
| D. 370,371 | | 6/1996 | Davet . |
| D. 389,339 | | 1/1998 | Garafano, Jr. . |
| D. 392,816 | | 3/1998 | Franklin et al. . |
| 3,718,260 | | 2/1973 | Sharp . |
| 4,016,972 | | 4/1977 | Szamborski . |
| 4,209,212 | | 6/1980 | McGoldrick . |
| 4,332,320 | | 6/1982 | Feibelman . |
| 4,371,077 | | 2/1983 | Solitt et al. . |
| 4,461,383 | | 7/1984 | Groff . |
| 4,552,264 | | 11/1985 | Quarrell et al. . |
| 4,735,246 | | 4/1988 | Niehaus . |
| 5,031,758 | * | 7/1991 | Gonzalez . |
| 5,078,264 | | 1/1992 | Garganese . |
| 5,242,048 | * | 9/1993 | Ellingsworth et al. . |
| 5,363,953 | | 11/1994 | Carter . |
| 5,593,025 | * | 1/1997 | Feibelman . |
| 5,671,849 | * | 9/1997 | Bacon . |

* cited by examiner

*Primary Examiner*—Terry Lee Melius
*Assistant Examiner*—William L. Miller
(74) *Attorney, Agent, or Firm*—Steven E. Ross; Alvin R. Wirthlin; Akin, Gump, Strauss, Hauer & Feld, L.L.P.

(57) ABSTRACT

The jewelry display device comprises a base portion and a display portion bearing an image, such as an image of a person. Openings, such as apertures and slits, adapted to accept and retain items of jewelry are positioned in the display portion such that the openings align with features of the image appearing on the display portion, thereby allowing items of jewelry to be displayed in a realistic, aesthetically pleasing manner.

17 Claims, 7 Drawing Sheets

JEWELRY DISPLAY DEVICE

FIELD OF THE INVENTION

This invention relates to jewelry display devices, and, more particularly, to improved jewelry display devices adapted to display various aspects of one or more pieces of jewelry in an attractive, aesthetically pleasing manner by realistically simulating the way the jewelry will appear when worn.

BACKGROUND

Ornamental jewelry, particularly fine jewelry, has long been a popular fashion accessory, and the commercial market for jewelry continues to grow and expand. One of the most important considerations in the commercial marketing of jewelry is presenting the jewelry in an attractive, aesthetically pleasing manner that will capture and maintain the attention of potential buyers. Additionally, space within retail jewelry display cases is limited, and it is therefore desirable for individual jewelry display devices, which are typically located within the display cases for security purposes, to occupy a minimum amount of surface area so that numerous pieces of jewelry or entire collections of jewelry may be efficiently displayed.

Presently, different types of jewelry, such as necklaces and earrings, are typically displayed on separate display devices. Earrings, for example, are typically displayed on small cards similar to the jewelry display card disclosed in U.S. Pat. No. 5,078,264 to Garganese. Necklaces are typically displayed on devices consisting of a raised, three-dimensional forms in the general overall shape of a portion of the neck and shoulders of a person, with the necklace being positioned around the neck portion of the form.

A number of disadvantages, however, are associated with the jewelry display devices typically used today. First and foremost, the jewelry display devices typically used today make it difficult for potential buyers to realistically visualize how the jewelry will appear when worn. Additionally, items of jewelry, such as necklaces and earrings, are often sold as matched sets, and the separate jewelry display devices typically used today make it inconvenient for potential buyers and salespersons to locate the various items of the matched set, particularly since necklaces and earrings are often displayed at different locations within a display case or even at entirely different locations within a jewelry store. Furthermore, the raised, three-dimensional forms often occupy an inordinately large amount of space within display cases, thus making it difficult to display a large number of necklaces in an attractive, uncluttered, aesthetically pleasing manner.

Therefore, a need exists for jewelry display devices that can display one or more items of jewelry in an attractive, aesthetically pleasing manner by realistically simulating how the jewelry will appear when worn.

SUMMARY OF THE INVENTION

The present invention alleviates disadvantages associated with jewelry display devices typically used today by providing jewelry display devices that are adapted to display various aspects of one or more pieces of jewelry in an attractive, aesthetically pleasing manner that realistically simulates how the jewelry will appear when worn. The jewelry display device comprises a display portion, which bears the image of a person. The display portion additionally comprises one or more openings adapted to accept jewelry, such as necklaces and earrings, with the openings being positioned with respect to the image so that the jewelry is displayed in a manner that realistically simulates how the jewelry will appear when worn. For example, the openings adapted to accept the earrings can be positioned so that they align with the earlobes of the image of the person on the display portion. The openings adapted to accept the necklace can be positioned so that they align with the shoulders and neck of the image of the person on the display portion. The display portion can be supported by a base portion, which allows the jewelry display device to be free-standing. Alternatively, the display portion can be utilized without a base portion, for example, as a window or wall display. The present invention allows the various items of a matched set of jewelry to be displayed on a single display device in a manner that realistically simulates how the various items will appear when worn together. The present invention is also space efficient, thereby allowing a larger number of jewelry pieces to be displayed in an attractive manner within a given jewelry display case. Moreover, a plurality of jewelry display devices according to the present invention, because they are space efficient, can be utilized to display the various items of a collection jewelry.

DETAILED DESCRIPTION OF DISCLOSED EMBODIMENTS

Figure 1:
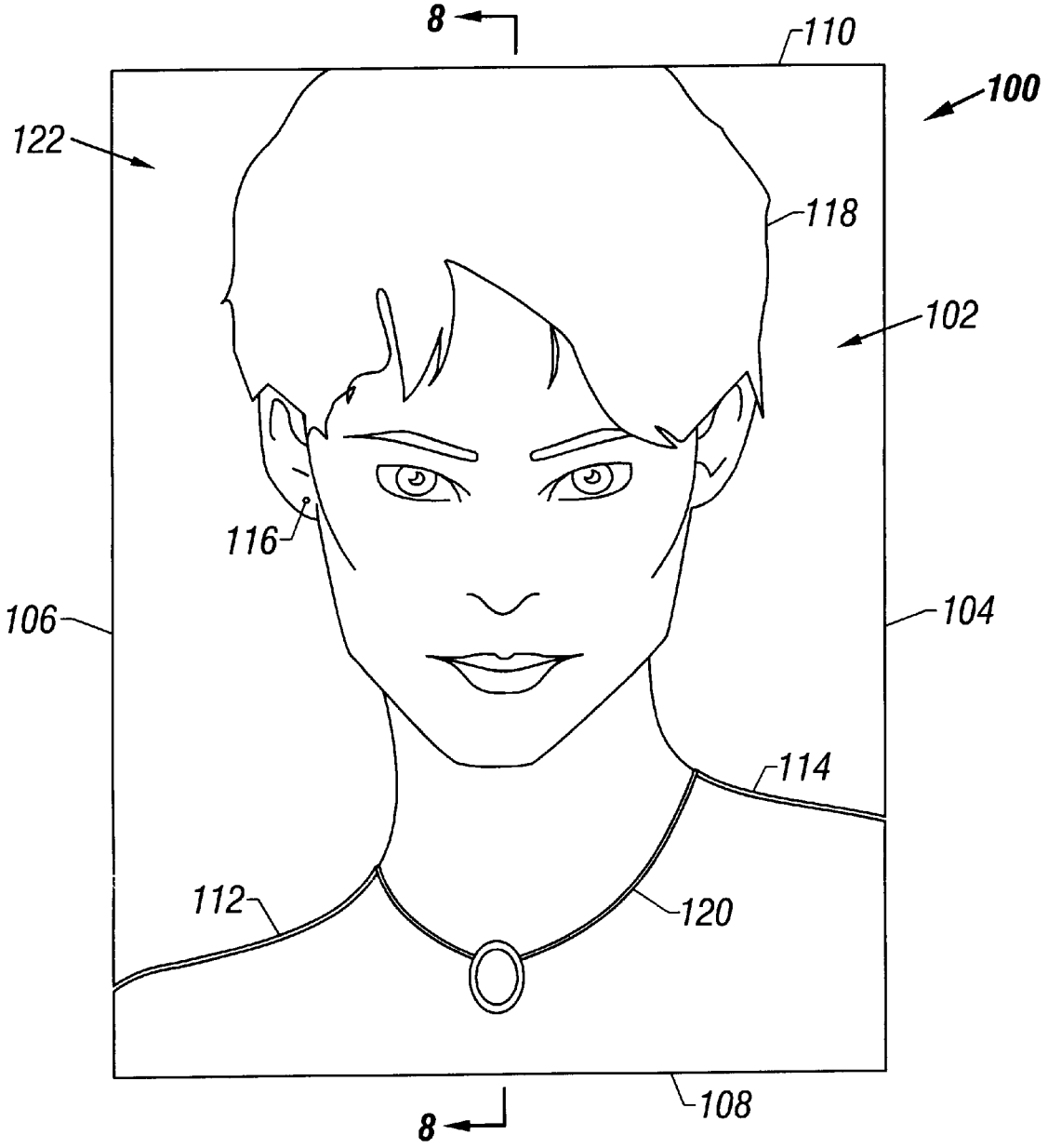
FIG. 1 is a front elevation view of a jewelry display device exemplifying the invention, the display device bearing the image of a human form (shown schematically by an outline) and displaying a necklace in accordance with one aspect of the invention.

In the description which follows, like parts are marked throughout the specification and drawings with the same referenced numerals, respectively. The drawing figures are not necessarily to scale and certain features may be shown in exaggerated or generalized form in the interest of clarity and conciseness.

Figure 2:
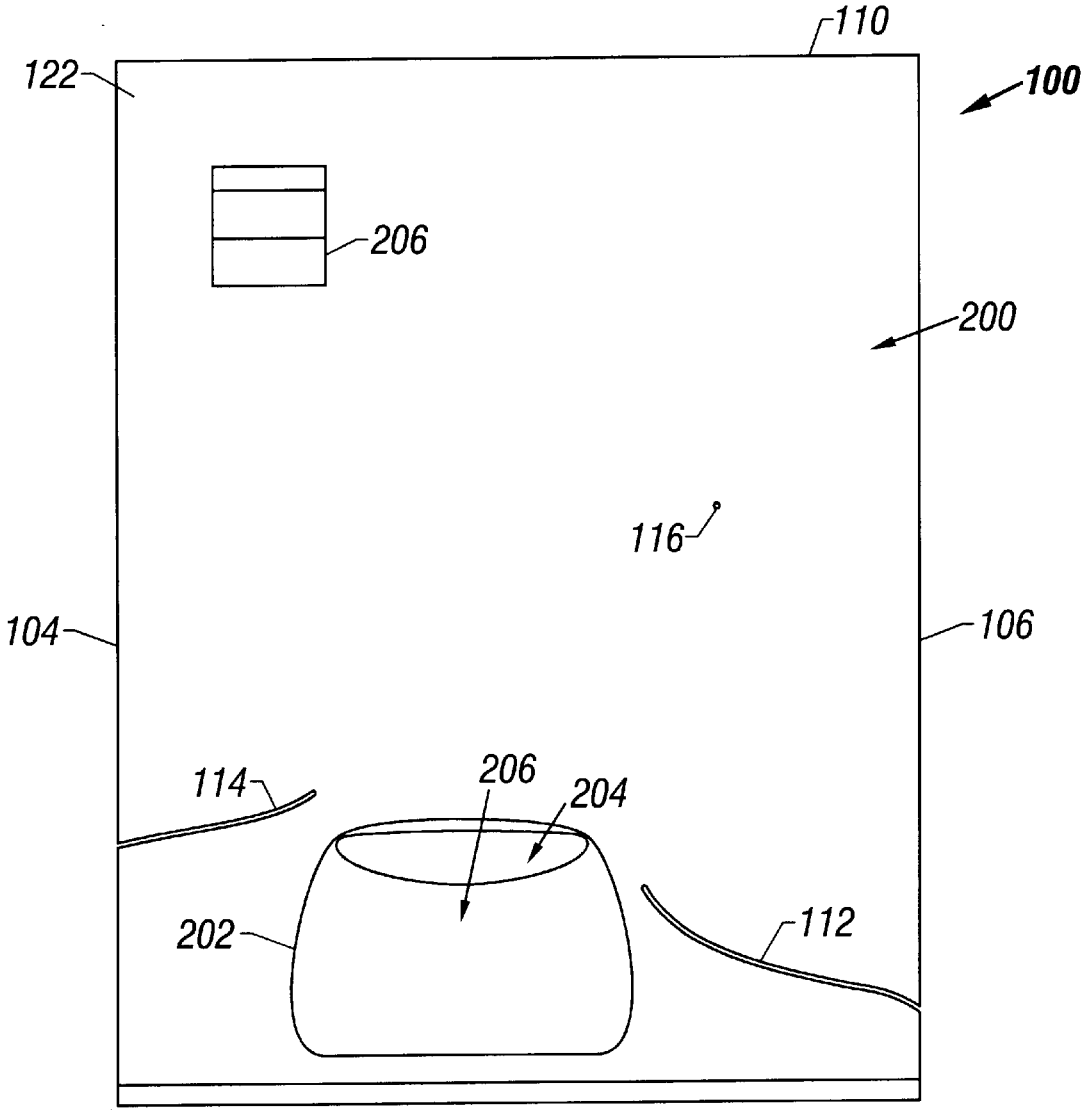
FIG. 2 is a rear elevation view in accordance with the invention.
Figure 3:
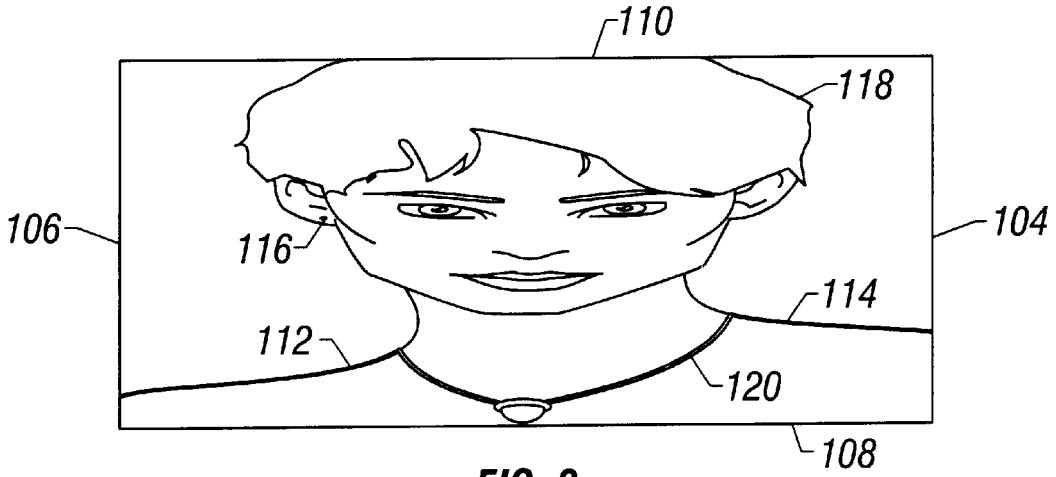
FIG. 3 is a top plan view in accordance with the invention.
Figure 4:
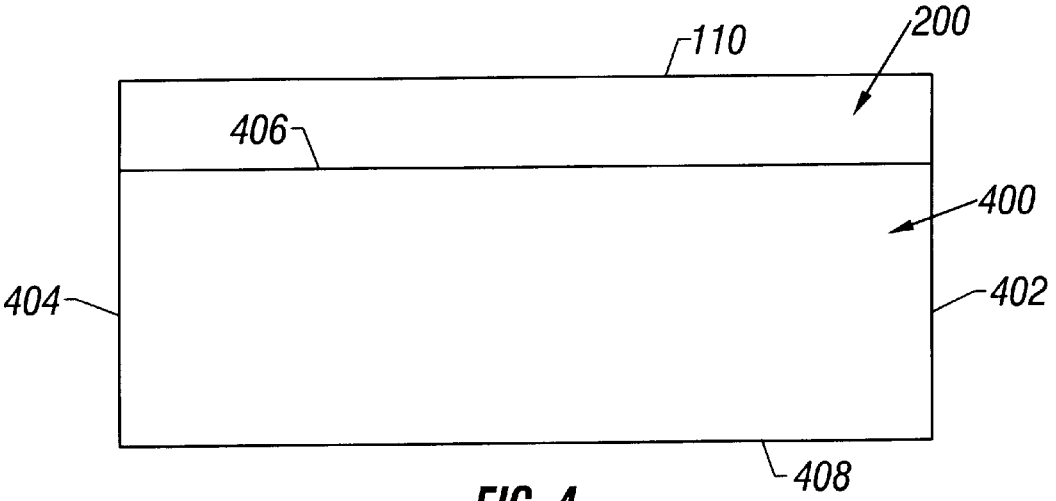
FIG. 4 is a bottom plan view in accordance with the invention.

Referring to FIGS. 1, 2, 3, and 4, in particular, there is illustrated a jewelry display device in accordance with one aspect of the present invention and generally designated by the numeral 100. The display device 100 comprises a front viewing area 102, a rear viewing area 200 opposed from the front viewing area 102, and a base 400. The front viewing area is defined by a top edge 110, a bottom edge 108, a left edge 106, and a right edge 104. Thus the front viewing area 102 is rectangular is shape, however, a wide variety of front viewing area 102 shapes can be implemented without detracting from the spirit of the invention. The bottom edge 108 is connected to the base 400. As shown best in FIGS. 5 and 6, the bottom edge 108 is connected to the base front edge 408. The bottom edge 108 can be fixedly attached to base front edge 408 or in another embodiment, the bottom edge 108 can be integral with the base 400. The latter occurs by forming the display device 100 from a contiguous piece of material, examples of which include metal or plastic. The front viewing area 102 includes an opening 116 and slits 112 and 114. However, a variety of openings can be incorporated in the front viewing area 102, including, but not limited to, a single opening, multiple openings, and multiple slits. Opening 116 is provided such that an article of jewelry, more specifically an earring for use with a pierced ear, is inserted through the opening and attached using the clasp and stud manner well-known in the art of jewelry. Slits 112 and 114 are adapted such that a necklace 120, which is shown in FIG. 1 as the dash-double dot line, may be inserted into the slits. The chain of the necklace 120 is placed within the slits 112 and 114 to a point where the necklace hangs from the slits 112 and 114 in a desired fashion. In one embodiment, the earring, when inserted in the opening 116, appears in the earlobe of the outlined FIG. 118, and the outlined FIG. 118 appears to be wearing the necklace 120. The necklace 120 and the outlined FIG. 118 are included for reference, and as such are drawn as a dashed lines. As can be seen in FIG. 2, the opening 116 and the slits 114 and 112 extend from the front viewing area 102 through to a rear area 200. An arm 206 is secured to the rear area 200. The arm 206 is implemented as a hook such that an article may be slipped over the protruding hook and suspended from a hook throat 500, thus allowing a price tag or description of the jewelry displayed on the front viewing area 102 to be conveniently supported for viewing. Alternative embodiments include, but are not limited to, a rounded hook, a peg, and a stud. The alternate embodiments allow for an article to be suspended without detracting from the spirit of the invention. A pouch 202 is fixedly attached to the rear area 200. The pouch 202 includes a cavity 206 and an opening 204 which allows for the storage of excess jewelry that is being shown on the front viewing area 102. If a necklace 120 is being displayed on the front viewing area 102, the remaining chain not visible from the front may be placed through the opening 204 and stored in the pouch 202 during the display. The pouch can rest on the base 400 and the pouch opening 204 can be closeable. The pouch 202 in the disclosed embodiment is produced from a fabric material; however, a wide variety of materials can be implemented without detracting from the spirit of the invention. In an alternate embodiment, the pouch can be fixedly attached to the base. In still another alternate embodiment, a substantially rigid container is fixedly attached to the display stand 100, and is adapted for the functions described above.

Figure 5:
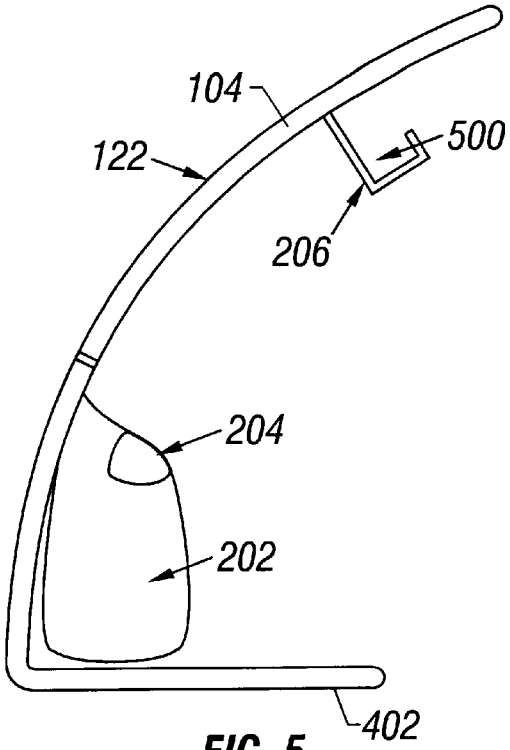
FIG. 5 is a side elevation view taken from the right in FIG. 1 in accordance with the invention.
Figure 6:
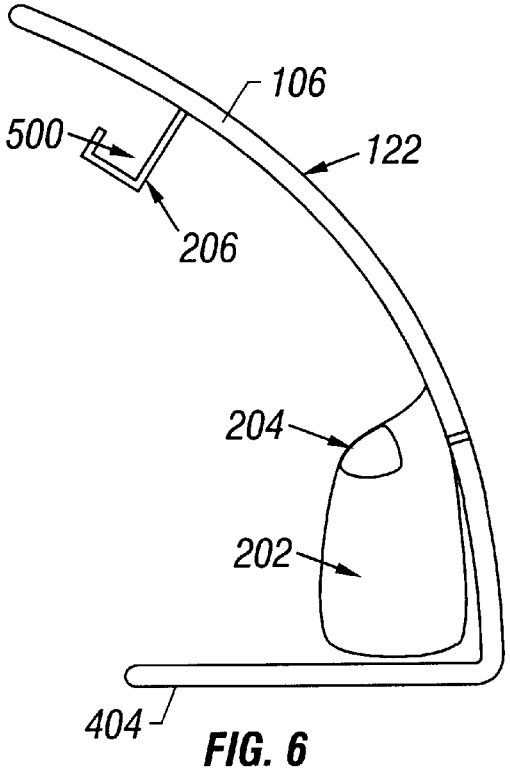
FIG. 6 is a side elevation view taken from the left in FIG. 1 in accordance with the invention.

The base 400 has a base front edge 408, a base rear edge 406, a base right edge 402, and a base left edge 404. The base is substantially flat, thus allowing for placement on a flat surface, or a surface that is generally parallel with the floor or planar. The base 400, as disclosed, is rectangular in shape, however, a wide variety of shapes can be implemented as a base without detracting from the spirit of the invention. As can be seen by FIGS. 5 and 6, display part 122 of display stand 100 and the base 400 form an acute angle. The display part 122 can be placed at a variety of levels of inclination, dependant upon the requirements of the total display design. Also as can be seen by FIGS. 5 and 6, the display part 122 can be arcuate. The amount of arc of the display part 122 also varies with the requirements of the total display design, and as such, do not detract from the spirit of the invention. The display part 122 can also be substantially planar.

Figure 7:
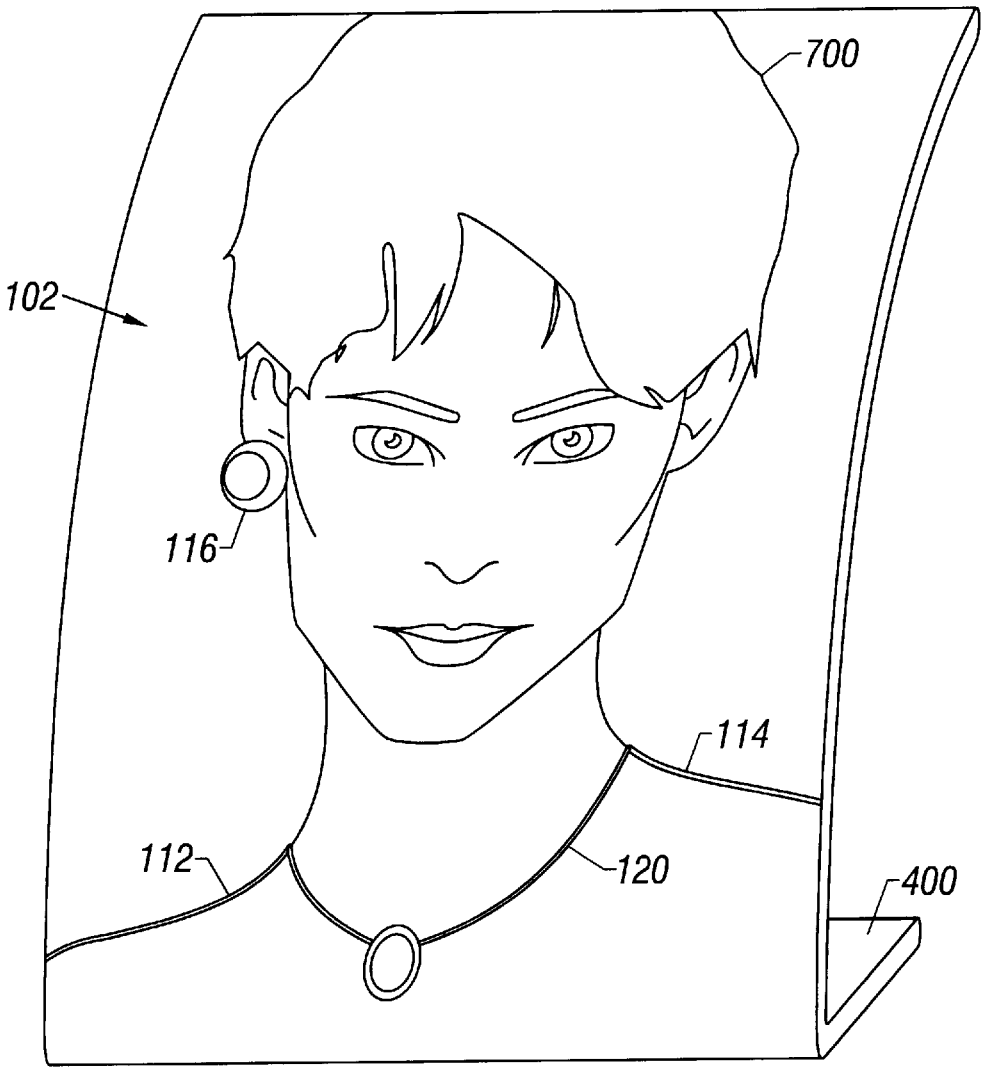
FIG. 7 is a perspective view of the jewelry display device in accordance with the invention.

FIG. 7 shows a perspective view of the display device 100. As can be seen, the front viewing area 102 can bear the image of a person 700 such that the lines defining the shoulder of the image 700 align with the slits 112 and 114. The image can be of a person or of a partial image of a person, such as the shoulder and head. Also, the earlobe of the image 700 is aligned with the opening 116. In the disclosed embodiment, a necklace 120 can be attached to the display device 100 through slits 112 and 114 providing the appearance of the image 700 wearing the necklace 120. An earring can also be attached through opening 116, further providing the appearance of the image 700 wearing the earring. Different images can be utilized on different display devices 100; the opening 116 and slits 112 and 114 are implemented to align with the specific image utilized on the front viewing area 102. In another embodiment, multiple openings 116 are implemented allowing for multiple earrings to be displayed on the front viewing area 102.

Figure 8:
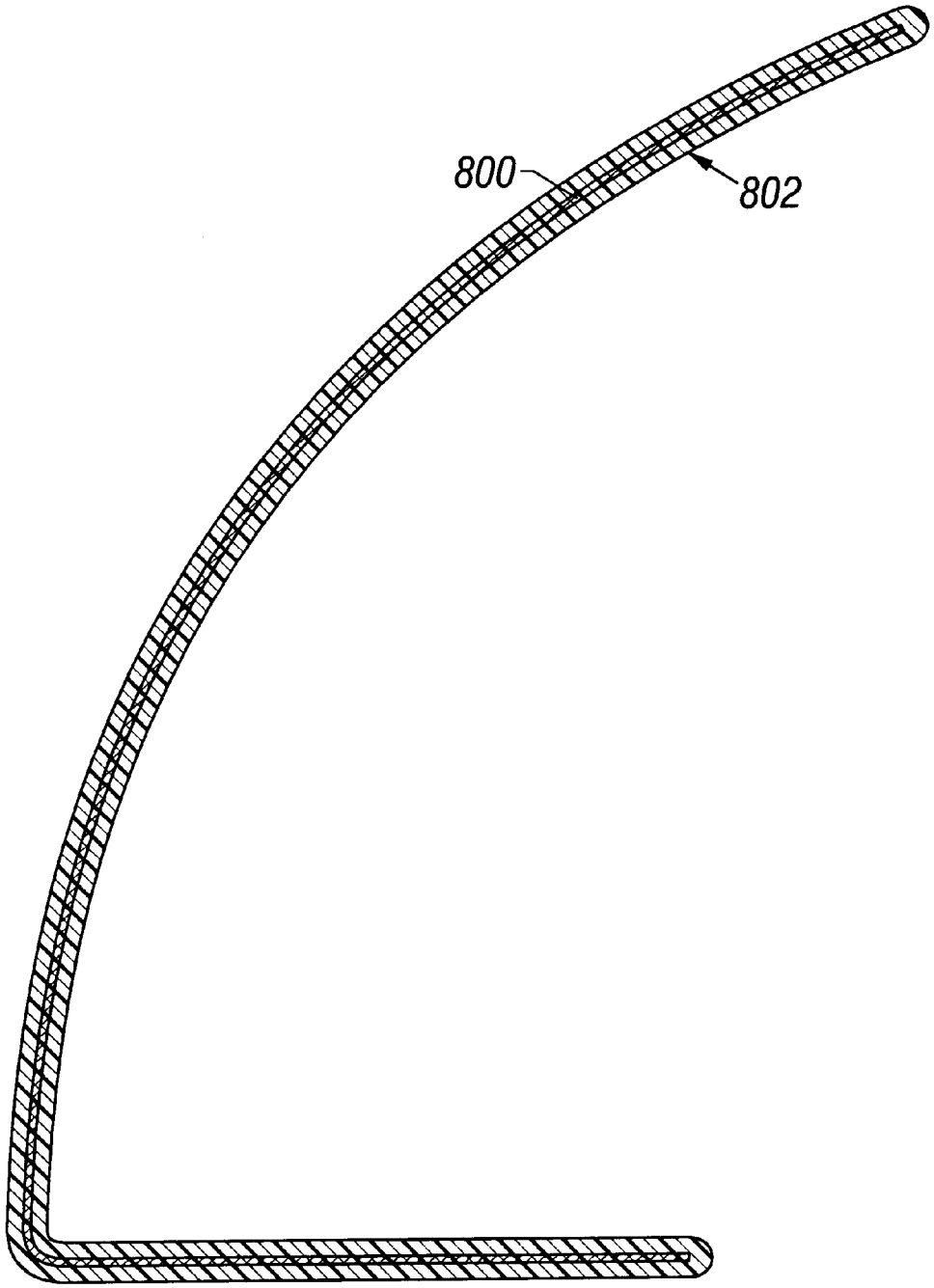
FIG. 8 is a cross-sectional view through lines 8—8 of FIG. 1 showing a detailed sectional view in accordance with the invention.

FIG. 8 discloses a sectional view through line 8—8 of FIG. 1. As can be seen, in one embodiment, a substantially firm core 800 is surrounded by a compressible cover 802. The substantially firm core can be formed from a relatively rigid material, such as metal or plastic, and the compressible cover 802 can be a fabric material, including a soft plastic or vinyl covering. The compressible cover 802 is fixedly attached to the firm core 800 with a binding agent or adhesive. A wide variety of attachment means can be implemented, including, but not limited to, molding with heat, applying an adhesive, and enveloping the firm core 800 with a fitted cover. These alternatives and many others are available and do not detract from the spirit of the invention.

Figure 9:
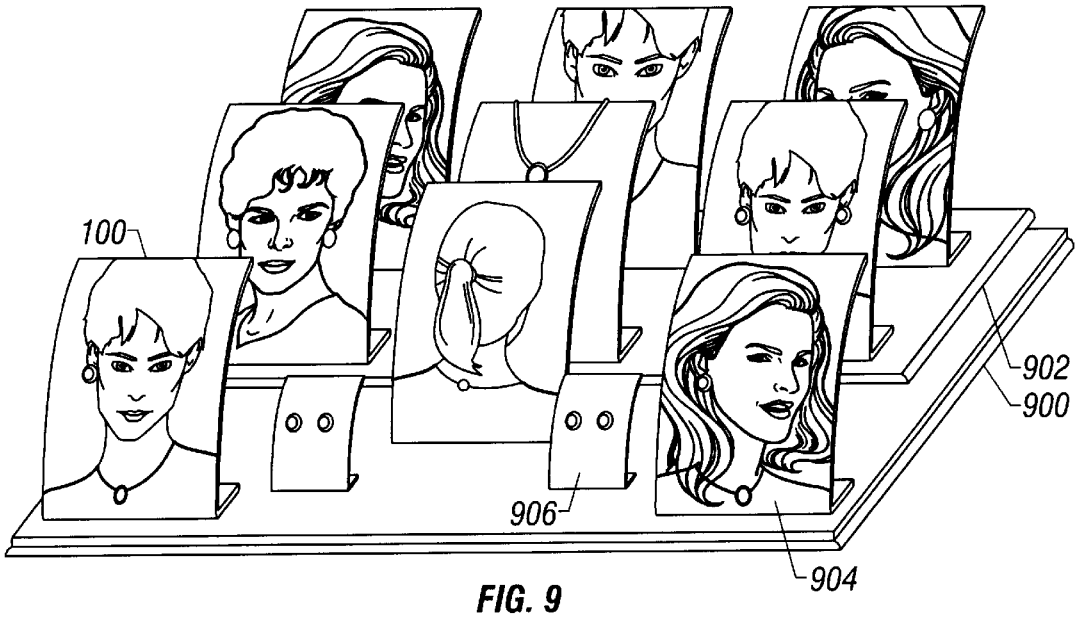
FIG. 9 is a perspective view of a plurality of jewelry display devices disposed upon a multi-leveled base in accordance with the invention.
Figure 10:
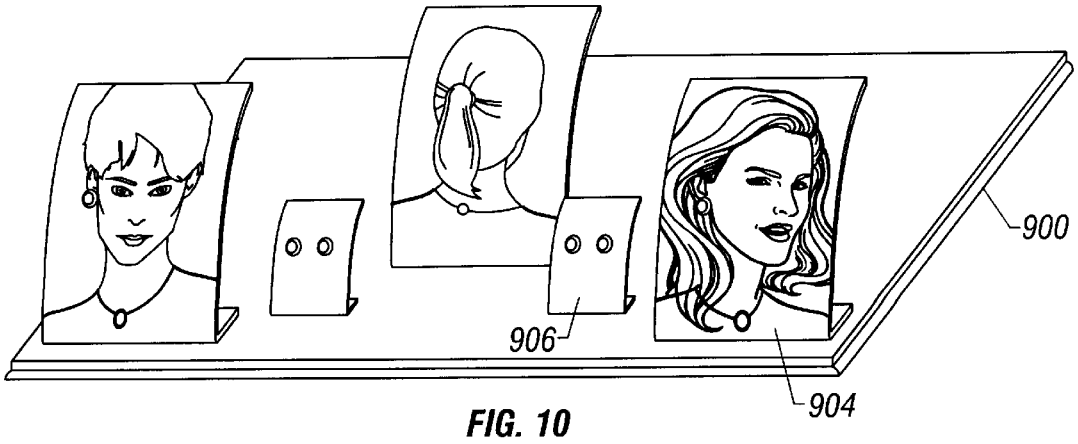
FIG. 10 is a perspective view or a plurality of jewelry display devices disposed on a single base in accordance with the invention.

FIGS. 9 and 10 show a display comprising a plurality of display devices 100 placed upon at least one level. A base stand 900 and a second stand 902 are shown to include several display devices 100 bearing images that can vary, such that each display device 100 bears a different image 904. Also, the display devices 100 can be modified such that no image appears 906. As can be seen, a three dimensional effect can be achieved by the placement of a second level 902 directly above the base level 900. The efficient shape of the display devices 100 allow for multiple necklaces 120 and earrings to be displayed in a confined area providing a unique display environment. The display can also include a single level as shown in FIG. 10, the display having display devices 100, including images 904 or display devices without images 906.

What is claimed is:

1. A jewelry display device, comprising:

a base;

a display part having a front viewing area and a bottom edge, the bottom edge of the display part connected to the base;

an image of at least a portion of a person located on the front viewing area; and first and second openings located in the display part, the first and second openings being aligned with spaced edges of the image, the openings being adapted to receive an elongate strand of jewelry for displaying the strand of jewelry on the image between the two openings.

2. The jewelry display device of claim 1, wherein the image of at least a portion of the person comprises the image of a person's shoulders and head, with the spaced edges being located at the shoulders.

3. The jewelry display device according to claim 1, wherein the first and second openings are slits.

4. The jewelry display device according to claim 1, wherein the display part is arcuate.

5. The jewelry display device according to claim 1, wherein the display part forms an acute angle with the base.

6. The jewelry display device according to claim 1, wherein the display part includes a rear area opposite the front viewing area; and further comprising a pouch operably associated with the rear area to receive a portion of the elongate strand of jewelry that extends through the openings from the front viewing area when the elongate strand ofjewelry is mounted on the jewelry display device.

7. The jewelry display device according to claim 6 wherein the pouch is connected to the rear area.

8. The jewelry display device according to claim 1, wherein the display part includes a rear area opposite the front viewing area; and further comprising a hook connected to the display part at the rear area for displaying information relating to an article of jewelry.

9. A jewelry display device, comprising:

a base;

a display part having a front viewing area and a bottom edge, the bottom edge of the display part connected to the base;

a rear area opposed to the front viewing area;

a pouch secured to the rear area; the pouch including a pouch opening and a cavity, wherein the pouch is adapted to receive jewelry;

at least one opening located in the display part, the opening for allowing the attachment of jewelry;

first and second slits located in the display part;

an image of a person borne upon the front viewing area, wherein the image of the person and the first and second slits align; and wherein the display part forms and acute angle with the base and the display part is arcuate.

10. A jewelry display device, comprising:

a display part having a front viewing area;

an image of at least a portion of a person located on the front viewing area; and first and second openings located in the display part, the first and second openings being aligned with spaced edges of the image, the openings being adapted to receive an elongate strand of jewelry for displaying the strand of jewelry on the image between the two openings.

11. The jewelry display device according to claim 10, wherein the first and second openings are slits.

12. The jewelry display device according to claim 10 wherein the display part is arcuate.

13. The jewelry display device according to claim 10, wherein the display part includes a rear area opposite the front viewing area; and further comprising a pouch operably associated with the rear area to receive a portion of the elongate strand of jewelry that extends through the openings from the front viewing area when the elongate strand of jewelry is mounted on the jewelry display device.

14. The jewelry display device according to claim 13, wherein the pouch is connected to the rear area.

15. The jewelry display device according to claim 10, wherein the display part includes a rear area opposite the front viewing area; and further comprising a hook connected to the display part at the rear area for displaying information relating to an article of jewelry.

16. The jewelry display device of claim 10, wherein the image of at least a portion of the person comprises the image of a person's shoulders and head, with the spaced edges being located at the shoulders.

17. The jewelry display device of claim 10, wherein the display part is constructed of a relatively firm core and a compressible cover attached to the core.

* * * * *